US012338554B2

(12) United States Patent
Puchowski

(10) Patent No.: US 12,338,554 B2
(45) Date of Patent: Jun. 24, 2025

(54) WEAVING LOOM

(71) Applicant: Lauren Puchowski, Jersey City, NJ (US)

(72) Inventor: Lauren Puchowski, Jersey City, NJ (US)

( * ) Notice: Subject to any disclaimer, the term of this patent is extended or adjusted under 35 U.S.C. 154(b) by 0 days.

(21) Appl. No.: 18/400,356

(22) Filed: Dec. 29, 2023

(65) Prior Publication Data

US 2024/0218573 A1 Jul. 4, 2024

Related U.S. Application Data

(60) Provisional application No. 63/435,903, filed on Dec. 29, 2022.

(51) Int. Cl.

*D03C 9/06* (2006.01)
*D03C 9/02* (2006.01)
*D03D 29/00* (2006.01)

(52) U.S. Cl.

CPC ..... *D03C 9/02* (2013.01); *D03C 2700/01* (2013.01)

(58) Field of Classification Search

CPC ..... D03D 29/00; D03D 41/00; D03D 35/00; D03D 49/02; D03D 51/04; D03D 49/00; D03D 41/002; D03D 49/50; D03D 49/68; D03J 1/00; D03J 1/22; D04B 5/00; D04B 3/00; D04B 39/00; D04B 35/02; D04B 7/08; D03C 13/00; D03C 5/02; D03C 9/06; D03C 9/0608; D03C 9/02; D03C 2700/01; A63H 33/3088; A44C 27/00

See application file for complete search history.

(56) References Cited

U.S. PATENT DOCUMENTS 1,160,132 A * 11/1915 Bliss ..... D03D 29/00 139/33
1,313,596 A * 8/1919 Hendrick ..... D03D 29/00 139/33
1,532,848 A * 4/1925 Well ..... D03D 29/00 139/33
2,139,879 A * 12/1938 Clark ..... D03D 29/00 139/33
2,242,210 A * 5/1941 Gallinger ..... D03D 29/00 139/33
2,253,329 A * 8/1941 Gallinger ..... D03D 29/00 139/33
2,380,233 A * 7/1945 Greenwood ..... D03D 29/00 139/33

(Continued)

*Primary Examiner* — Robert H Muromoto, Jr.
(74) *Attorney, Agent, or Firm* — Innovent Law P.C.; Karima F. Gulick

(57) ABSTRACT

A weaving loom of the present disclosure includes a base and a heddle. The base has a first portion and a second portion. The first portion has a heddle base and first fins extending from the heddle base. The heddle is detachably coupled with the heddle base and has an axis and a central part. The heddle further includes a plurality of shedding sections formed on the central part and around the axis. The shedding sections are arranged along the axis for the central part to have a plurality of longitudinal rows having different topographies across different longitudinal portions of the central part. The heddle is configured to move between a plurality of positions with one of the longitudinal rows facing vertically upward.

20 Claims, 14 Drawing Sheets

(56) References Cited

U.S. PATENT DOCUMENTS

| | | | | | |
|---|---|---|---|---|---|
| 3,804,127 | A * | 4/1974 | Rose | D03D 29/00 | 28/151 |
| 3,994,526 | A * | 11/1976 | Swain | A47C 13/00 | 297/118 |
| 4,046,172 | A * | 9/1977 | Russell | D03D 29/00 | 139/33 |
| 4,074,726 | A * | 2/1978 | Harris | D03D 29/00 | 139/29 |
| 4,109,685 | A * | 8/1978 | Westin | D03D 29/00 | 139/33 |
| 4,160,467 | A * | 7/1979 | Woodruff | D03D 29/00 | 139/55.1 |
| 4,178,970 | A * | 12/1979 | Mueller | D03D 29/00 | 139/33 |
| 7,658,210 | B1 * | 2/2010 | Nyce | D03D 41/00 | 139/33 |
| 7,677,273 | B2 * | 3/2010 | Skaflestad | D04D 9/02 | 139/30 |
| 7,762,284 | B2 * | 7/2010 | Ricks | D04D 1/04 | 223/48 |
| 8,316,894 | B2 * | 11/2012 | Schaub | D04B 3/00 | 139/34 |
| 9,121,117 | B2 * | 9/2015 | Teramoto | D03D 29/00 | |
| 9,506,171 | B2 * | 11/2016 | Nitta | D03D 41/00 | |
| 9,695,530 | B2 * | 7/2017 | Hall | D04D 1/04 | |
| 9,896,789 | B2 * | 2/2018 | Okuma | D03D 29/00 | |

* cited by examiner

WEAVING LOOM

TECHNICAL FIELD

The present disclosure relates to weaving loom used to weave cloth, thread and fabric. More particularly, the present invention relates to a weaving loom capable of making fabric of different patterns.

BACKGROUND

Children and adults both love a hands-on approach of learning how to weave their own fabric. For beginners, it is best to start with weaving loom that is relatively simple in construction and operation to learn all the basics of weaving. However, the numerous attempts to construct a weaving loom for hand weaving have been met with the objections that the loom was too complicated and cumbersome to be operated successfully by an unskilled person. Currently, the weaving looms on the markets may not be constructed in such a way to make them portable and easy to assemble on a go.

Firstly, the heddles of weaving looms currently on the market are normally fixed to a frame and thus prevent a user from switching said heddle with a different one in the middle of weaving operation to make different patterns on the fabric.

Further, the contemporary heddles have only two different topographies and are made to create two different arrangements of shed or temporary separation between upper and lower warps through which the weft is woven. Thus, only two types of wefts are made possible using contemporary weaving looms. Making more complicated weaves using contemporary heddles requires the use of more heddles which considerably increases the size of the weaving loom. Also, whether powered by machine or by hand, anything more complicated than a simple weave usually requires complicated mechanisms and multiple moving parts.

Thus, there is a need for a weaving loom whose heddle can be easily removed from the corresponding frame to be replaced with a new heddle.

There is also a need for a weaving loom capable of making a fabric of more complicated weaves in a compact size.

As will be disclosed below, the present disclosure addresses these needs and covers a device and method to aid in weaving fabric.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified.

DETAILED DESCRIPTION

The embodiments can now be better understood by turning to the following detailed description of the embodiments, which are presented as illustrated examples of the embodiment defined in the claims. It is expressly understood that the embodiments as defined by the claims may be broader than the illustrated embodiments described below. Many alterations and modifications may be made by those having ordinary skill in the art without departing from the spirit and scope of the embodiments and claims.

Figure 1:
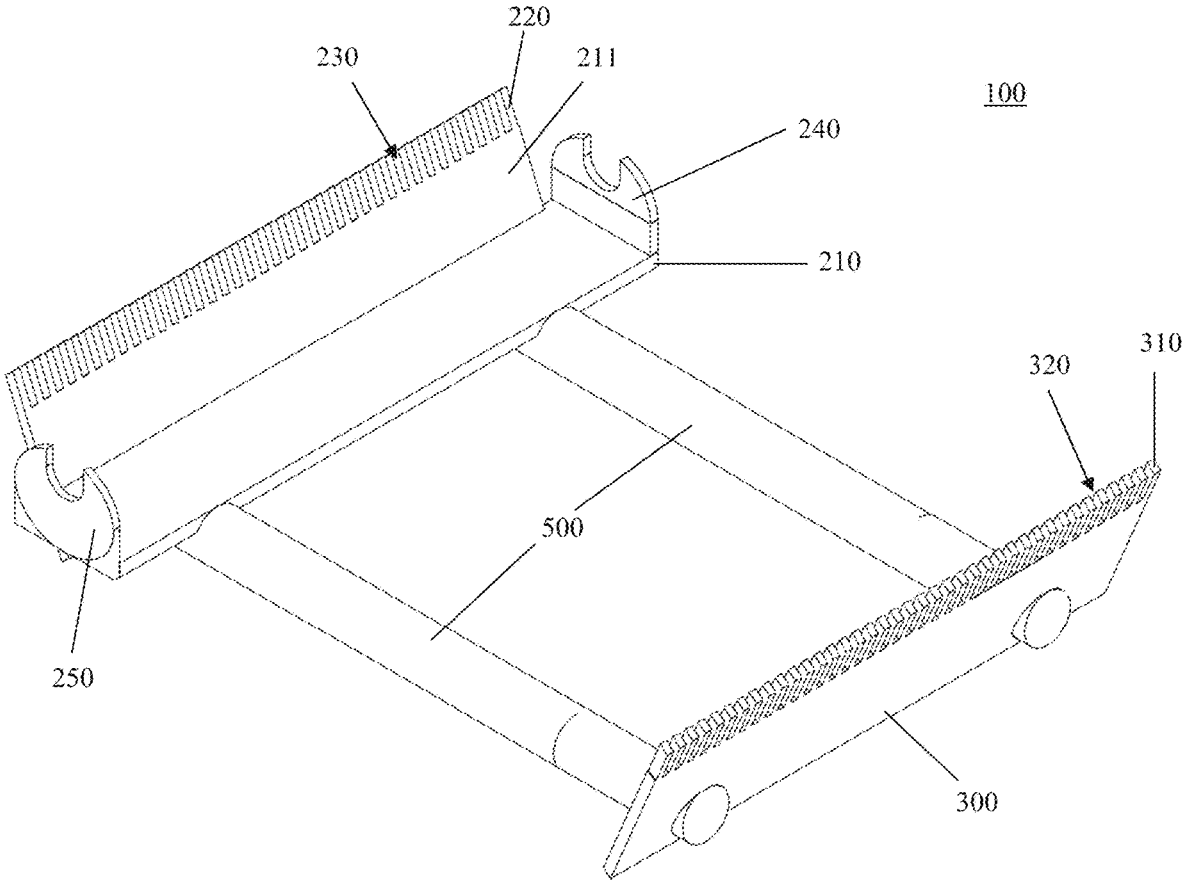
FIGS. 1-3 are respectively a perspective view, a top view, and a side view of the base of the weaving loom according to the first embodiment of the present disclosure.
Figure 2:
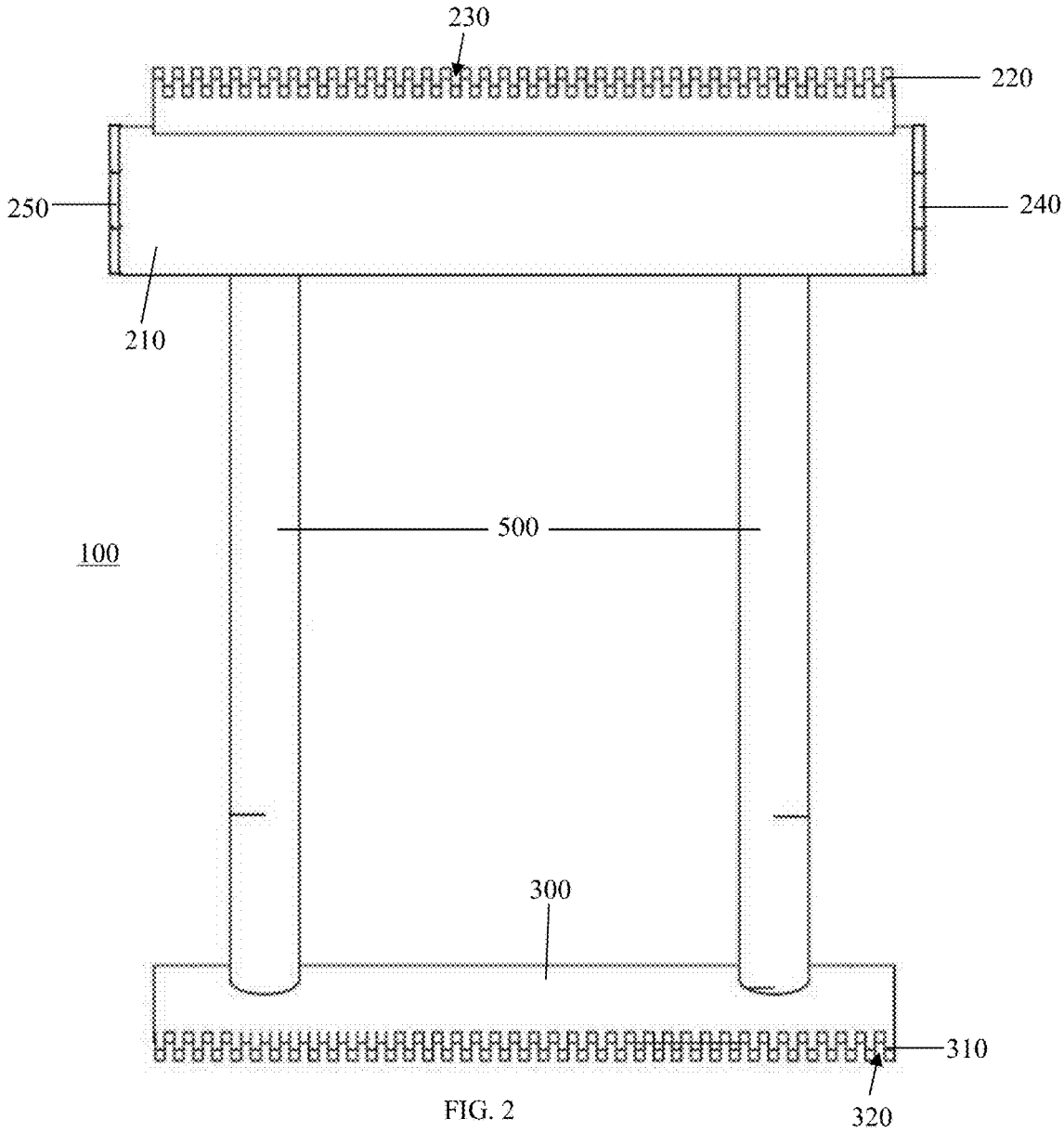
Figure 3:
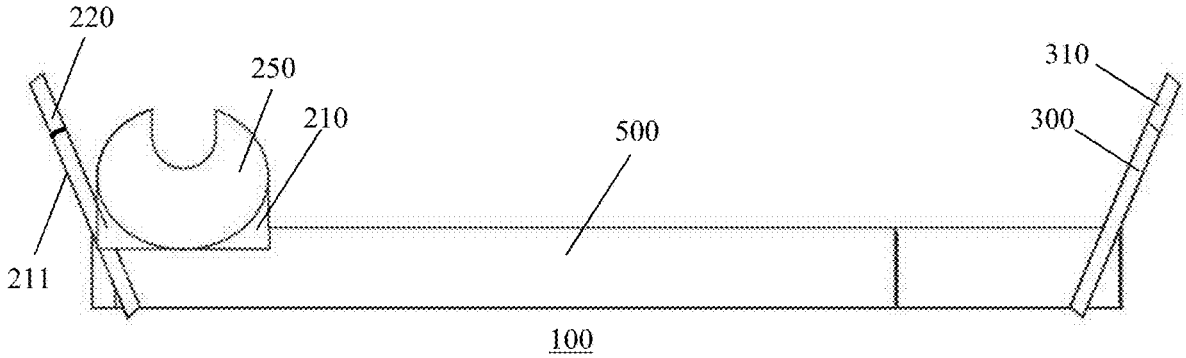

FIGS. 1-3 are respectively a perspective view, a top view, and a side view of the base 100 of the weaving loom according to one embodiment of the present disclosure. The base 100 includes a first base portion and a second base portion 300 separate from each other. The first base portion has a heddle base 210, a first arm 211 extending from the heddle base 210, and a plurality of first pins 220 extending from the first arm 211, wherein a first gap 230 is formed between two adjacent first pins 220. In the present embodiment, the first arm 211 extends obliquely from the heddle base 210 and the first pins 220 extends obliquely from the first arm 211. However, in different embodiments, either one or both of the first arm 211 and first pins 220 can be perpendicular to the heddle base 210.

The first base portion further includes a first heddle rest 240 and a second heddle rest 250 respectively extending from two opposite sides of the heddle base 210. In the present embodiment, the first and second heddle rests 240, 250 are perpendicular to the heddle base 210. However, in different embodiments, either one or both of the heddle rests 240, 250 can extend obliquely from the heddle base 210.

On the other hand, the second base portion 300 includes a plurality of second pins 310 extending from the second base portion 300, wherein one second gap 320 exists between two adjacent second pins 310. In the present embodiment, the second base portion 300 is a rectangular disc almost identical with the first arm 211 and with the second pins 310 extending therefrom. However, in different embodiments, the second base portion 300 can also include a base similar to the heddle base 210, a second arm similar to the first arm 211 that extends from said base, and the second pins 310 that extend from said second arm.

The weaving loom further includes a pair of base connectors 500 configured to couple with both the first base portion and the second base portion 300. As illustrated in FIGS. 1-3, two ends of the base connector 500 are coupled with the two base portions in such a way that first pin 220 and the second pin 310 are preferably on the same level. The second base portion 300 is oriented to be oblique with respect to the base connector 500 and can also be configured to be perpendicular to the base connector 500. Further, the base connector 500 of the present embodiment are two bars coupled with different parts of the first and second base portions. In different embodiment, the base connector 500 can include a board, a table, disc, or other conventional and preferably straight or flat components to fix the positions of the base portions relative to one another.

In one embodiment, the first and second base portions can be fixed on two opposite ends of a flat surface such as a table. For instance, a user can clamp the two base portions to the surface of a table using conventional attachment means such as screws, bolts, clamps, etc. In yet another embodiment, the first base portion, second base portion, and base connector can be part of the same undivided piece of material. For instance, the base can be made of one undivided piece of metal, wherein the base connector is the middle section of the metal piece and the two base portions are two opposite ends of the metal piece.

Figure 4:
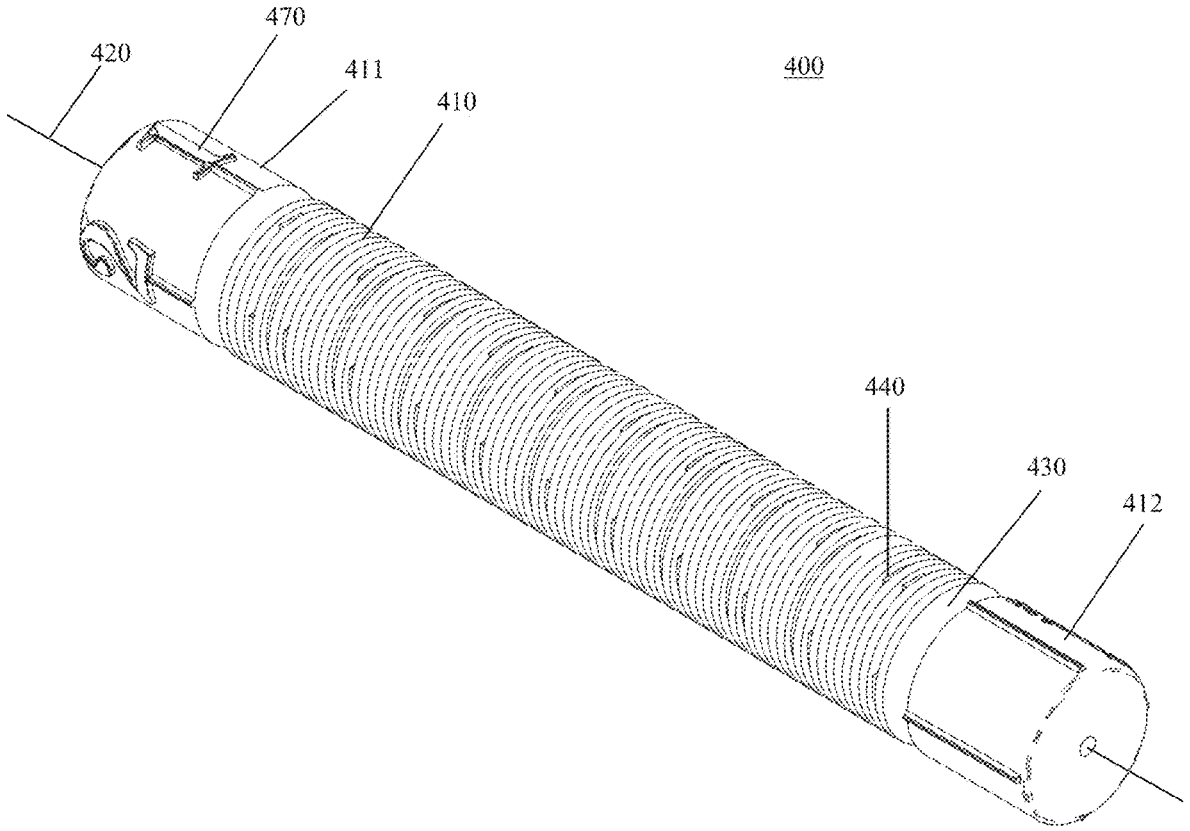
FIGS. 4-5 are perspective views of the heddle according to the first embodiment of the present disclosure.
Figure 5:
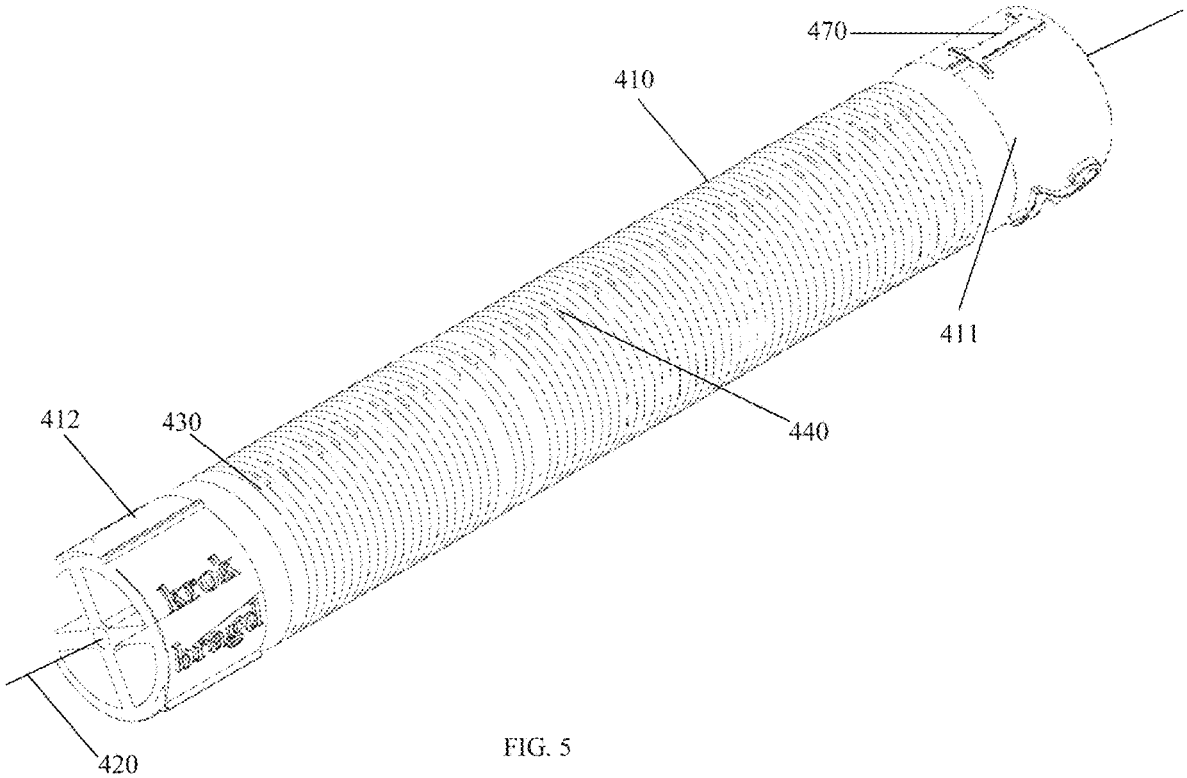
Figure 6:
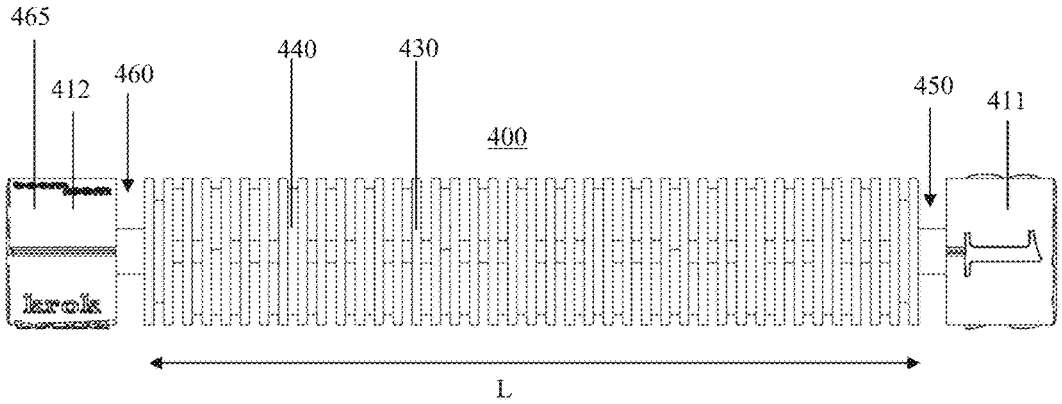
FIGS. 6-8 are side views of the heddle according to the first embodiment of the present disclosure.
Figure 7:
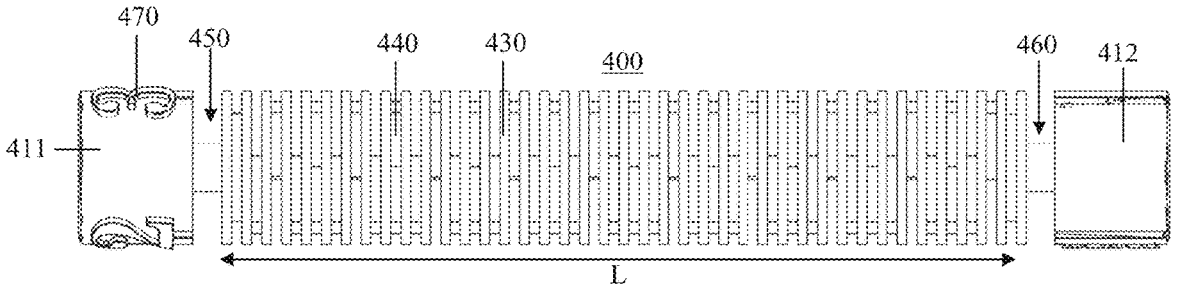
Figure 8:
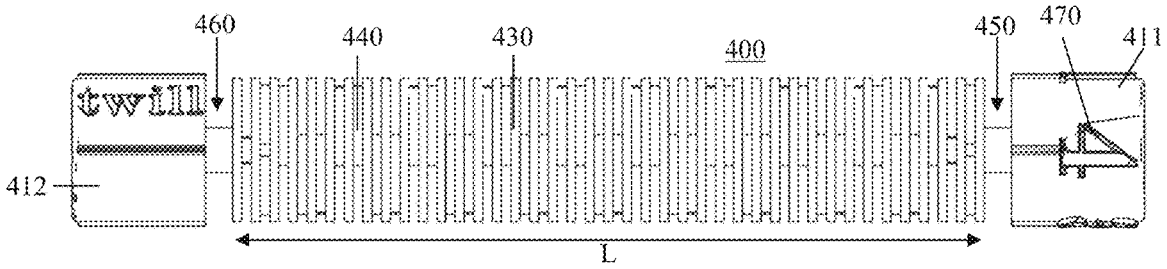

FIGS. 4-5 are two perspective views and FIGS. 6-8 are three side views of the heddle 400 according to one embodiment of the present disclosure. The heddle 400 is configured to detachably couple with the first and second heddle rests 240, 250 of the heddle base 210. The heddle 400 includes a central part 410, a first heddle end 411, and a second heddle end 412. As illustrated in FIGS. 6-8, the heddle 400 includes a first groove 450 formed between the first heddle end 411 and the central part 410. The first groove 450 is configured for the first heddle rest 240 to move within the first groove 450 and couple with the axle of the heddle 400. Similarly, the heddle 400 includes a second groove 460 formed between the second heddle end 412 and the central part 410 and configured for the second heddle rest 250 to move within the second groove 460 and couple with the axle of the heddle 400. Further, the first and second heddle rests 240, 250 are not fixed with the axle of the heddle 400. Thus, the heddle 400 can be easily removed and switched with another one in the middle of a weaving, so that multiple patterns can be made in one weaving session.

The central part 410 includes a plurality of pin sections 430 and a plurality of shedding sections 440. In the present embodiment, one shedding section 440 is located between two adjacent pin sections 430 and vice versa. The exceptions for the above-mentioned set are the pin sections 430 on both ends of the central part 410. The shedding section 440 does not fully occupy the space between the adjacent pin sections 430 and thus forms a slot between the adjacent pin sections 430. The pin sections 430 has a shape of a disc and preferably have identical shape and size. On the other hand, the shedding sections 440 are preferably smaller than the pin sections and have different shapes and sizes.

As illustrated in FIGS. 6-8, the first heddle end 411 includes four numeral designations 470 each corresponds and is assigned to four different longitudinal portions L of the central part 410. The four longitudinal portions L have different sets of shedding sections 440 and slots across various longitudinal portions L of the central part 410, wherein slots differ in depth across the longitudinal portions L. In other words, at least four longitudinal portions L of the central part 410 have different topographies.

Figure 9:
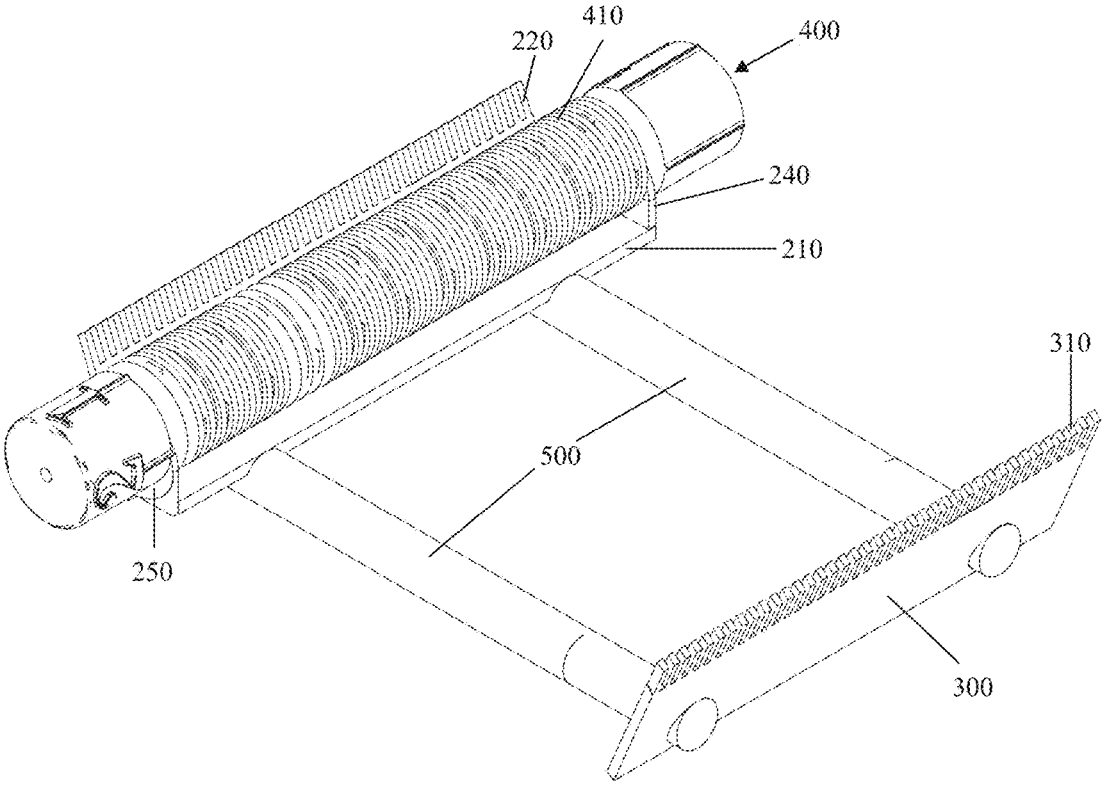
FIGS. 9-11 are respectively a perspective view, a top view, and a side view of the weaving loom according to the first embodiment of the present disclosure.
Figure 10:
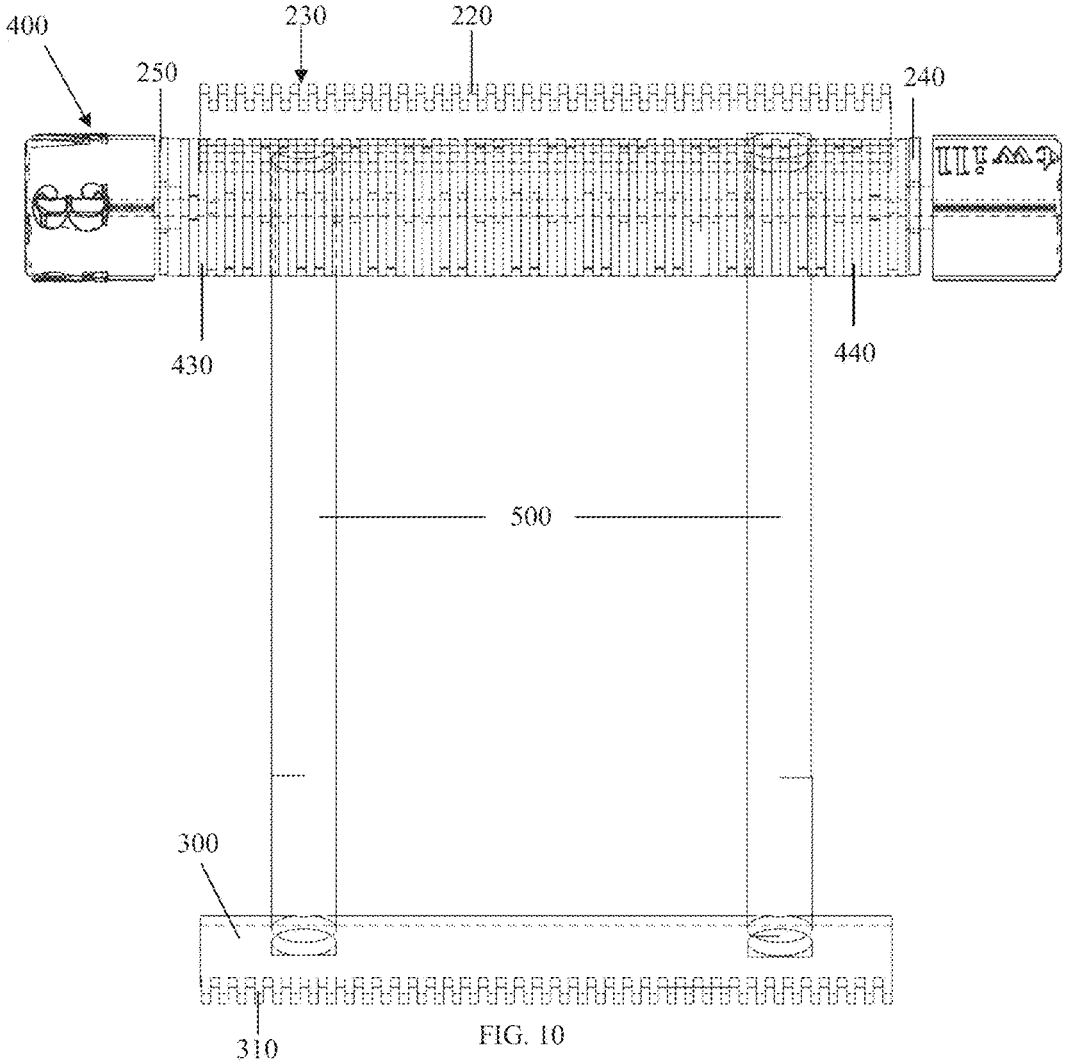
Figure 11:
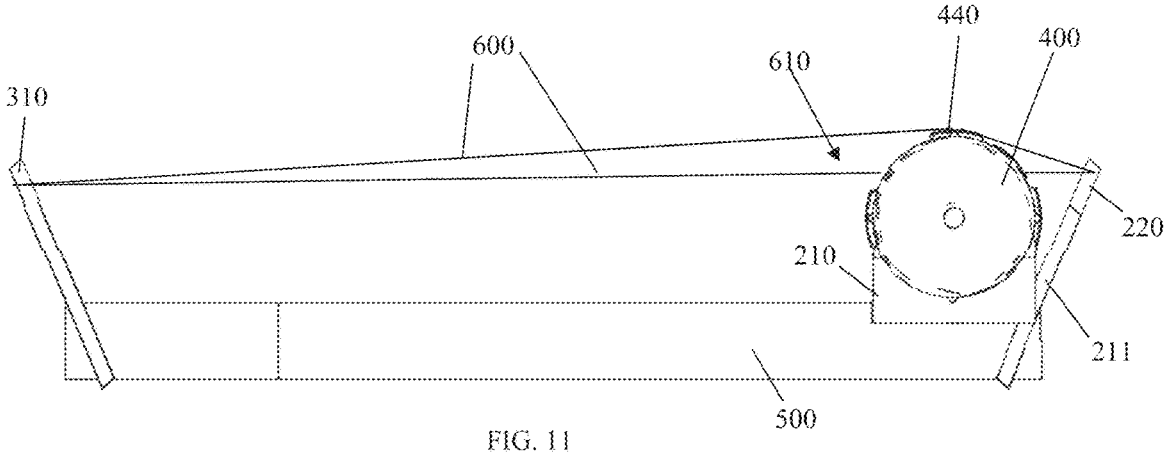

FIGS. 9-11 are respectively a perspective view, a top view, and a side view of the weaving loom according to one embodiment of the present disclosure, wherein the heddle 400 is detachably coupled with the first and second heddle rests 240, 250. In the present embodiment, the user can use either of the first and second heddle ends 411, 412 as a knob to rotate the heddle 400 in order for one of the longitudinal portions of the central part 410 and its own set of shedding sections 440 to face vertically upward. Please note that almost every pin section 430 faces a first pin 220 and almost every shedding section 440 faces a first gap 230.

Figure 12:
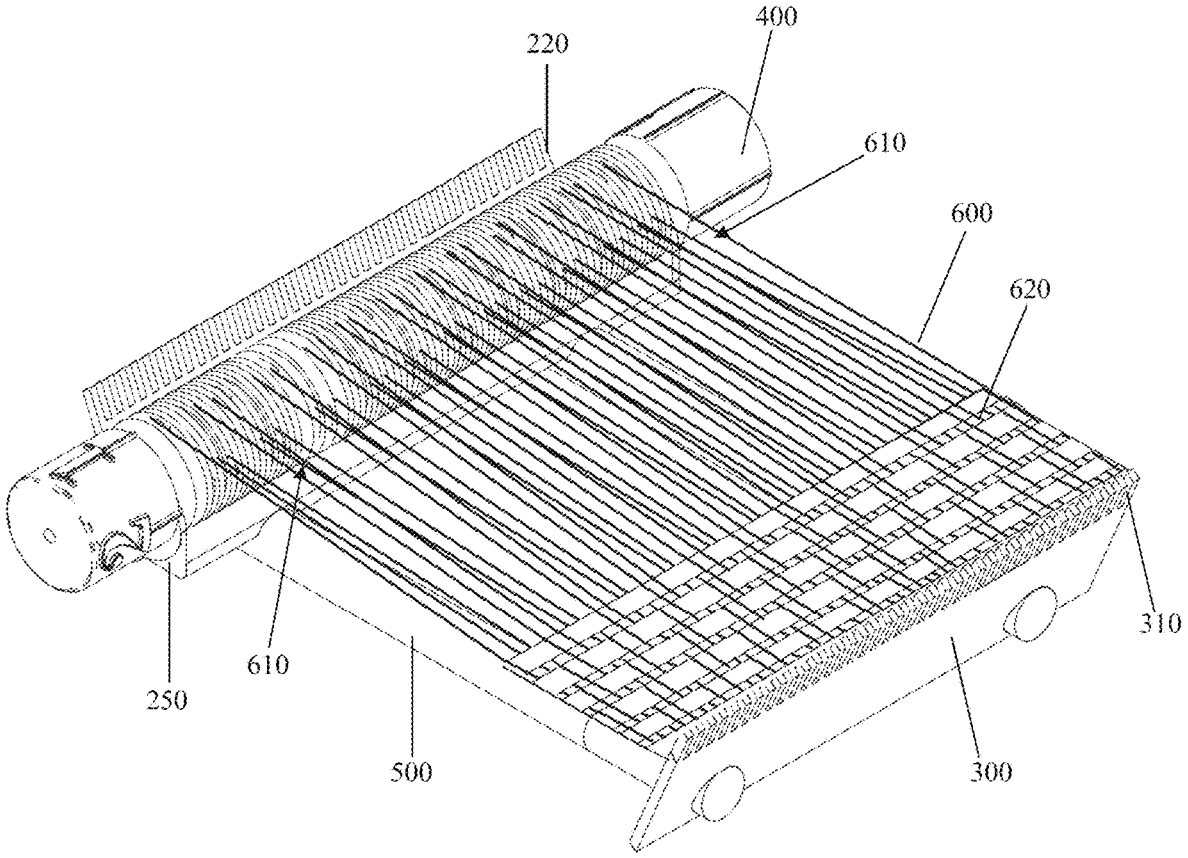
FIG. 12 is a perspective view of the weaving loom of the first embodiment having a warp and a plurality wefts formed on the warp.

In the embodiment illustrated in FIGS. 11-12, a warp 600 can be formed between the first pins 220 and the second pins 310. The warp is formed by wrapping a warp thread around one first pin 220 and then wrap the same warp thread around one second pin 310 to create a tightened thread between the two pins 220, 310. The user can use a single long warp thread or a plurality of separate warp threads to create the warp, as long as a plurality of parallel and tightened threads are formed between the first and second pins 220, 310. The above-mentioned shedding sections 440 facing vertically upward will move a portion of the warp threads vertically upward. Also, it is preferably that the central part 410 is comparable in width to the first arm 211 and the second base portion 300, so that a pair of first and second pins 220, 310 always corresponds to a pin section 430 and one first gap 230 always corresponds to a shedding section 440. In different embodiments, the base 100 can be designed to be expandable in width to have more first and second pins 220, 310, if additional weaving space is desired. The heddle 400 can also be replaced with one expanded in width to match the expansion of the base.

FIG. 12 is a perspective view of the weaving loom having a warp 600 and a plurality wefts 620 formed on the warp 600. The weaving loom allows user to create warp thread after coupling the base with the heddle 400. To create the warp threads illustrated in FIGS. 12-13, the user can start by wrapping the warp thread around one first pin 220 at one end of the base and then wrap the same warp thread around the second pin 310 on the other end of the base. The very first warp 600 has just been created on the weaving loom. The user can repeat the warp creating process until the warp thread wraps around at least the first pins 220 and second pins 310 to form the warp illustrated in FIG. 12. The user can then finish the warp creating process by tying one end of the warp thread with any one of the first pins 220 and second pins 310. It is also advisable to tenson the warp threads equally when wrapping around the first and second pins 220, 310. The user should also make sure the warp threads are properly wrapped around the first and second pins 220, 310 and it's not going to slide down later, as it might mess the tension of the overall warp 600.

To create a fabric, a shed 610 or a space separation must be created between two groups of warps 600. Basically, the shed 610 is the temporary separation between upper and lower warps 600 through which the weft 620 is woven. The shed 610 is created to make it easy to interlace the weft 620 into the warps 600 and thus create a woven fabric. The shed 610 allows for a shuttle carrying the weft thread or simply a single weft thread to move through the shed 610 relative to the warps 600. Which warps 600 are raised or which are lowered can be changed after each pass of the weft thread.

To create a shed 610, the user rotates the heddle 400 in either a clockwise or anti-clockwise direction. The user can decide the section of the heddle 400 to face upward and thus the part of the warp 600 to be raised by said section. For instance, if the designation 470 associated with the numeral "1" faces upward, then the longitudinal section of the central part 410 and the shedding sections 440 associated with that "1" designation 470 will also face upward to move the warps 600 above the heddle 400 further up. At this moment, a shed 610 is created between a set of upper and lower warps 600 as illustrated in FIGS. 11-12. This is also the moment the user can start creating weft 620 by passing the weft thread through the newly created shed 610.

To create another weft 620, the user turns the heddle 400 in either a clockwise or anti-clockwise direction. Now, if the designation 470 associated with the numeral "2" faces upward, then the longitudinal section of the central part 410 and the shedding sections 440 associated with that "2" designation 470 will also face upward to move the warps 600 above the heddle 400 further up. A new shed 610 is created between a set of upper and lower warps 600 different from that described in the previous paragraph. This is also the moment the user can make another weft 620 by passing the weft thread through the newly created shed 610.

The user can then start making another weft 620 by rotating the heddle 400 in either a clockwise or anti-clockwise direction again and then passing the weft thread through another shed 610. The weft creating process continues until the desired fabric pattern or fabric is complete to the user's satisfaction.

Figure 13:
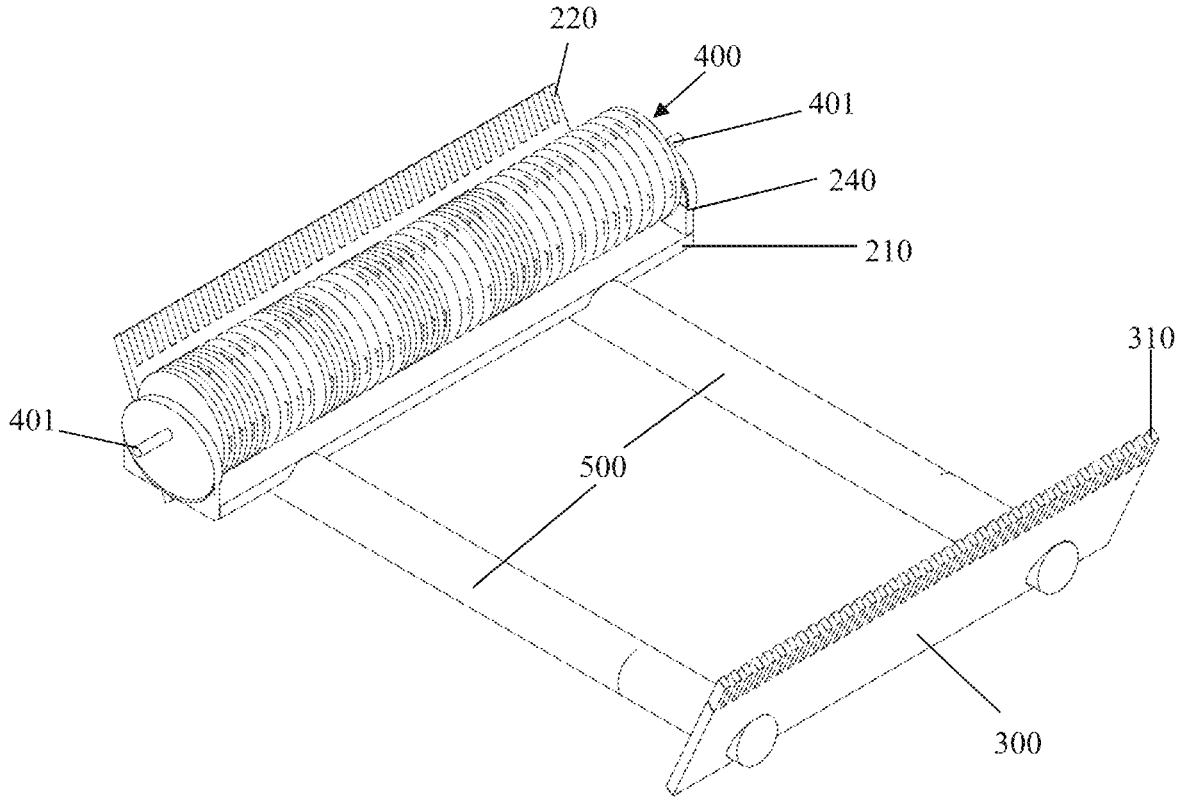
FIGS. 13-14 are respectively a perspective view and a top view of the weaving loom according to a second embodiment of the present disclosure.
Figure 14:
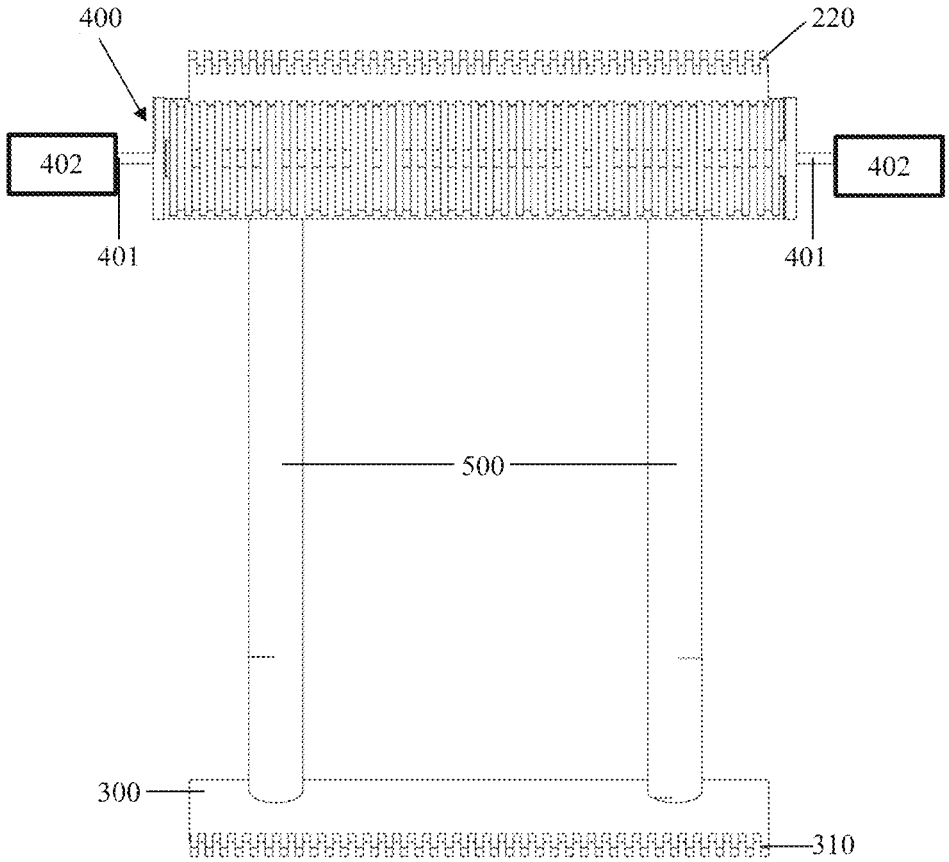

FIGS. 13-14 are respectively a perspective view and a top view of the weaving loom according to another embodiment of the present disclosure. The heddle 400 further includes a pair of axles 401 extending from two opposite ends of the heddle 400. The axle 401 is configured to mechanically coupled with a driver 402 that produces a rotary motion to rotate the heddle 400 through the axles 401. Thus, a user can use the coupling between the axle 401 and driver 402 to rotate the heddle 400 without manually operating the heddle 400. In the present embodiment, the driver 402 is an electric rotational motor but can also be a mechanical rotational motor in other embodiments.

Figure 15:
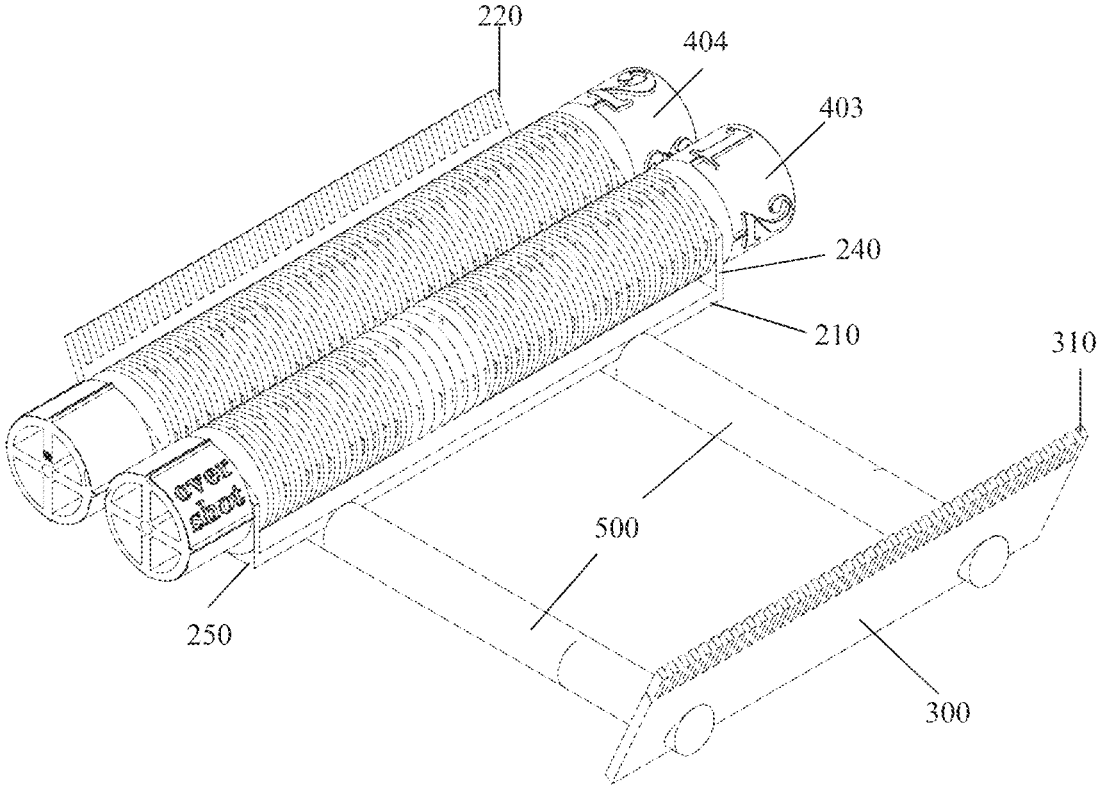
FIGS. 15-16 are respectively a perspective view and a top view of the weaving loom according to a third embodiment of the present disclosure.
Figure 16:
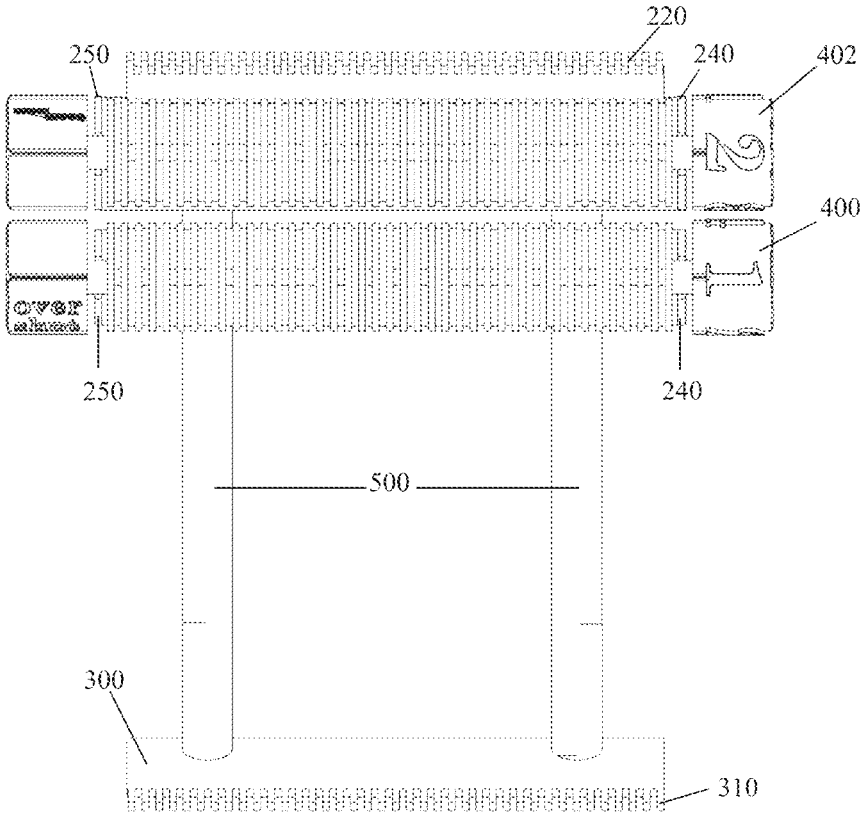

FIGS. 15-16 are respectively a perspective view and a top view of the weaving loom according to another embodiment of the present disclosure. The weaving loom of the present embodiment includes a first heddle 403 and a second heddle 404 placed on the first base portion or one side of the base 100. The first and second heddles 403, 404 are structurally similar to the heddle 400 described in the previous paragraph. The first base portion includes a heddle base 210 and two pairs of first heddle rest 240 and second heddle rest 250 extending from the heddle base 210. The pair of heddle rests 240, 250 are configured to accommodate the first and second heddles 403, 404. As illustrated in FIGS. 15-16, different longitudinal sections of the first and second heddles 403, 404 are positioned to face upward to move the warp similar to the one illustrated in FIG. 12. The two different longitudinal sections have different topographies and thus can create shed that a single heddle can never do and wefts different from the ones created using only one heddle. The first and second heddles 403, 404 can thus be used together to create fabrics with more complicated patterns. In other embodiments, other numbers of heddles and heddles that have different overall structures can be placed on the heddle base 210 to create fabrics with more complicated patterns.

Whether powered by machine or by hand, weaving usually requires complicated mechanisms and multiple moving parts. The cylindrical heddle design of the present disclosure makes the movement simple and efficient, while still allowing for the production of complex patterns. This design translates the multiple shafts of a traditional loom into one piece, and the lifting and lowering of those parts of the heddle or shafts into a simple 360 degree motion.

Figure 17:
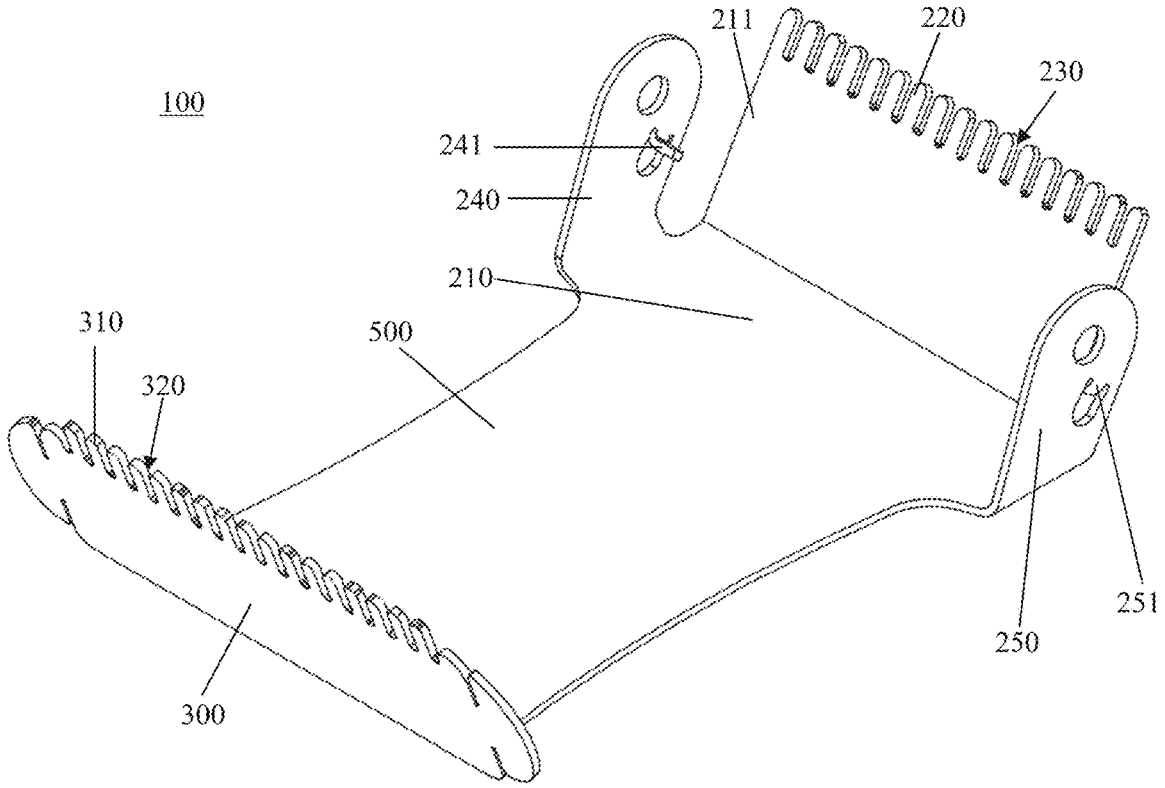
FIGS. 17-18 are respectively a perspective view and a side view of the base of the weaving loom according to the second embodiment of the present disclosure.
Figure 18:
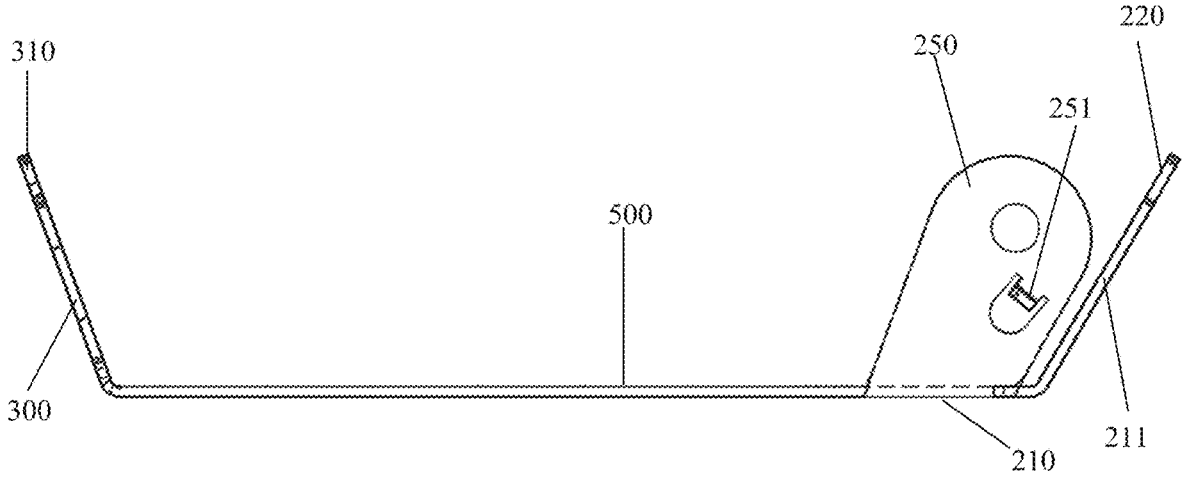

FIGS. 17-18 are respectively a perspective view and a side view of the base 100 of the weaving loom according to another embodiment of the present disclosure. The base 100 includes a first base portion and a second base portion 300 on two opposite ends of the base 100. The first base portion has a heddle base 210, a first arm 211 extending from the heddle base 210, a plurality of first pins 220 extending from the first arm 211, wherein a first gap 230 is formed between two adjacent first pins 220. In the present embodiment, the first arm 211 extends obliquely from the heddle base 210 and the first pins 220 extends obliquely from the first arm 211. However, in different embodiments, either or both of the first arm 211 and first pins 220 can be perpendicular with respect to the heddle base 210.

The first base portion further includes a first heddle rest 240 and a second heddle rest 250 respectively extending from two opposite sides of the heddle base 210. In the present embodiment, the first and second heddle rests 240, 250 are perpendicular to the heddle base 210. However, in different embodiments, either one or both of the heddle rests 240, 250 can extend obliquely from the heddle base 210. As illustrated in FIG. 17, the first heddle rest 240 includes a first stop 241 extending toward the second heddle rest 250. The second heddle rest 250 includes a second stop 251 extending toward the first heddle rest 240. The first and second stops 241, 251 are configured in order for the heddle 400 of the present embodiment to be rotatably placed on the stops 241, 251 and the first arm 211.

On the other hand, the second base portion 300 includes a plurality of second pins 310 extending from the second base portion 300, wherein one second gap 320 exists between two adjacent second pins 310. In the present embodiment, the second base portion 300 is a flat disc with the second pin 310 extending therefrom. The second base portion 300 is almost identical in shape to the first arm 211 and its first pins 220. In the present embodiment, the base 100 is made of one undivided piece of metal, wherein the base connector is the middle section of the metal piece and the two base portions are two opposite ends of the metal piece.

Figure 20:
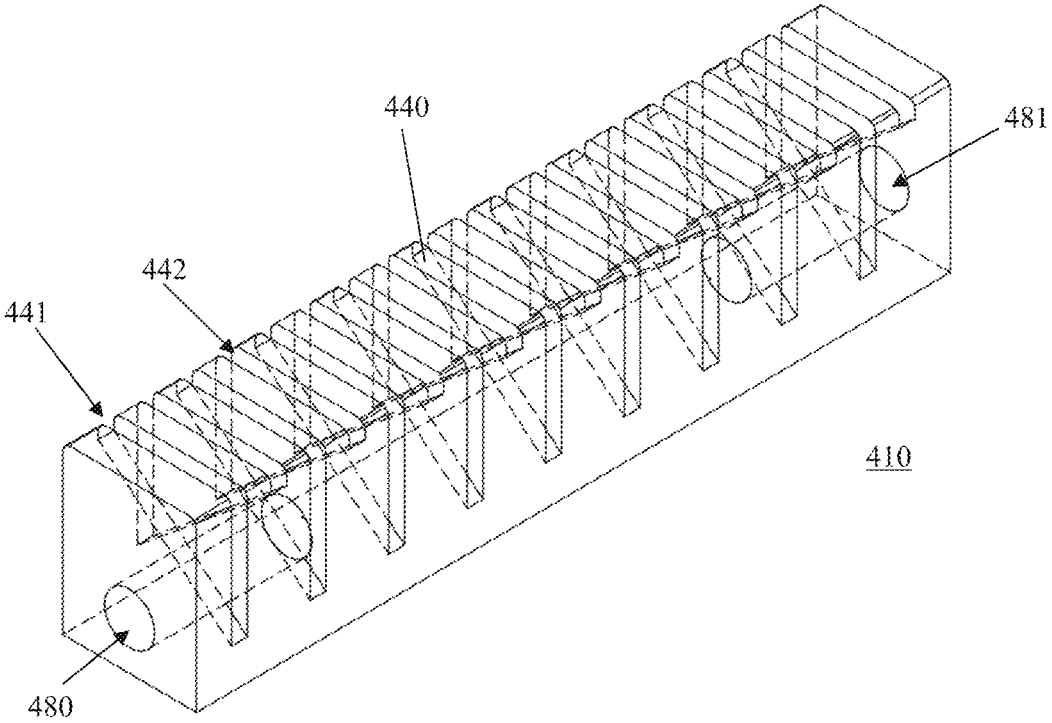

FIGS. 29-20 are respectively two perspective views of the central part 410 of the heddle according to another embodiment of the present disclosure. The central part 410 is configured to be removably and rotatably placed on the first arm 211 as well as the first and second heddle rests 240, 250 of the heddle base 210. The central part 410 includes a first hole 480 and a second hole 481 formed on its two opposite sides. The first hole 480 is configured for a bar to pass through the opening on the first heddle rest 240 (illustrated in FIG. 17) and the first hole 480 to rotatably couple the heddle 400 with the first heddle rest 240. Similarly, the second hole 481 is configured for a bar to pass through the opening on the second heddle rest 250 (illustrated in FIGS. 17-18) and the second hole 481 to rotatably couple the heddle 400 with the second heddle rest 250.

Figure 19:
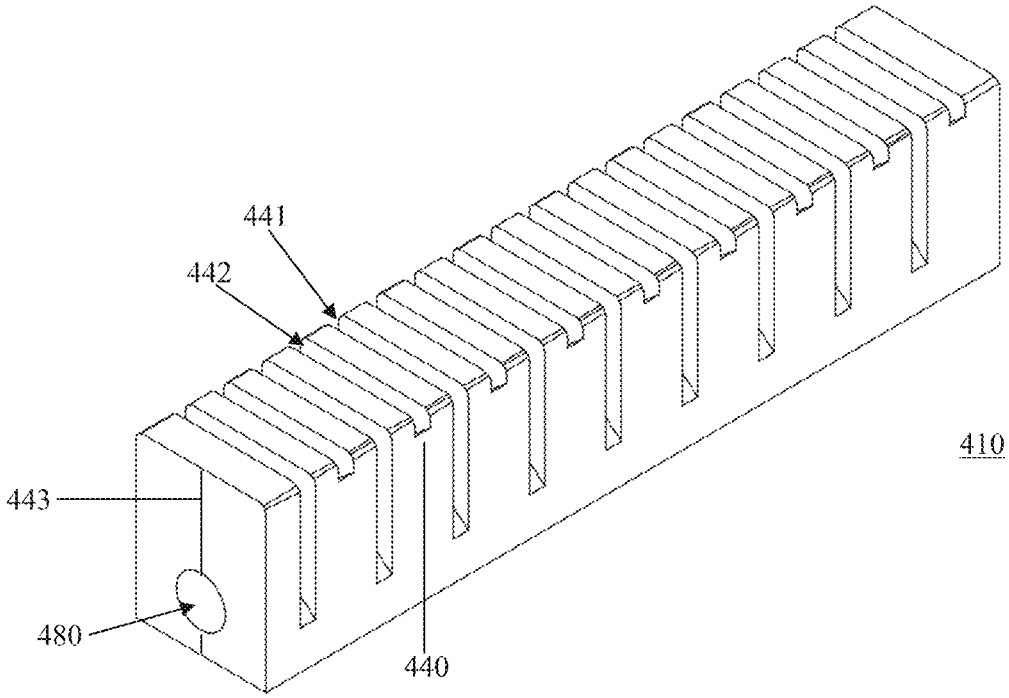
FIGS. 19-20 are perspective views of the central part of the heddle according to the second embodiment of the present disclosure.

The central part 410 further includes a plurality of first slots 441 and a plurality of second slots 442. In the present embodiment, except for the first slots 441 on both ends of the central part 410, every first slot 441 is located between two second slots 442 and vice versa. However, in different embodiments, two or more first slots 441 can be located between two second slots 442 and vice versa. The first and second slots 441, 442 preferably are equal in size. Further, as illustrated in FIG. 18, the first and second slot 441, 442 mirror each other with respect to the central line 443 illustrated in FIG. 19. As illustrated in FIGS. 19-20, the central part 410 includes a plurality of shedding sections 440 configured to contact a portion of the warp threads and move that portion of the warp vertical upward or downward to create a shed separate between the moved warp threads and the rest of the warp threads. As mentioned above, one first slot 441 is located between two second slots 442 and vice versa. Thus, except for the warp threads on two ends of the warp, the elevated warp thread will be adjacent to two unelevated warp threads and vice versa.

Figure 21:
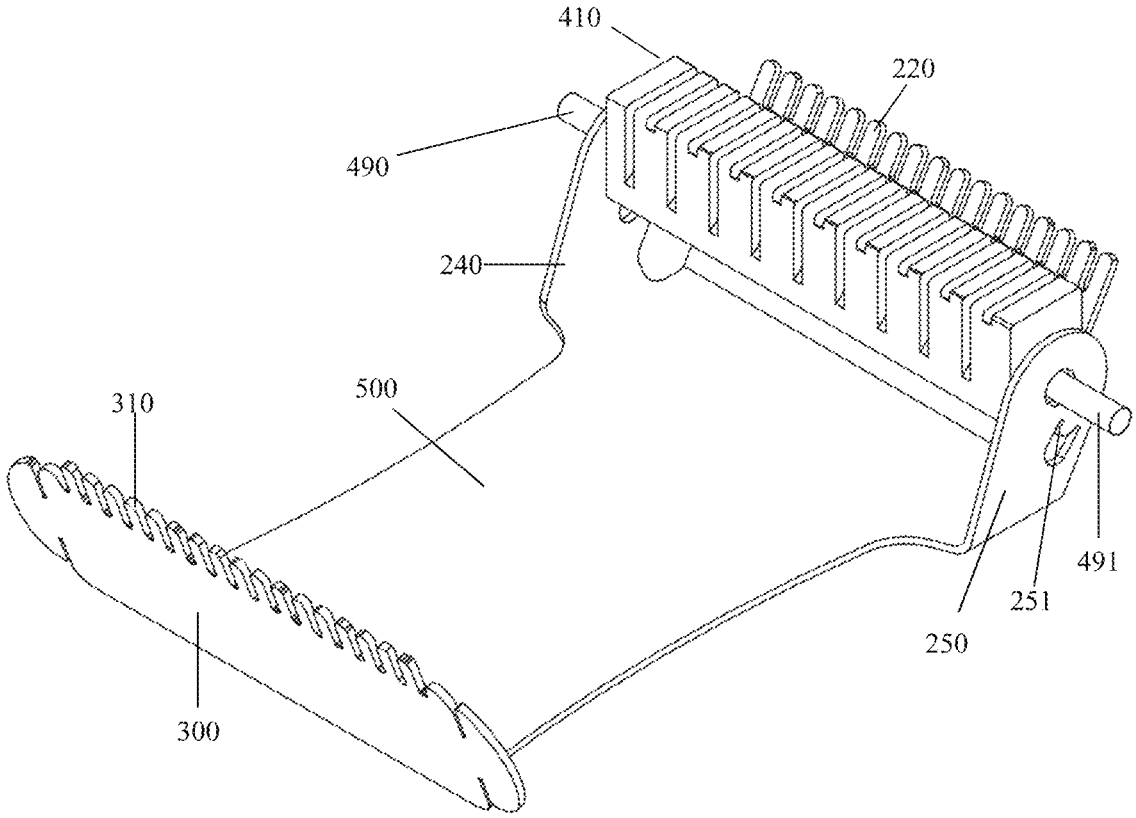
FIGS. 21-22 are respectively a perspective and a top view of the heddle rotatably coupled with the base according to the second embodiment of the present disclosure.
Figure 22:
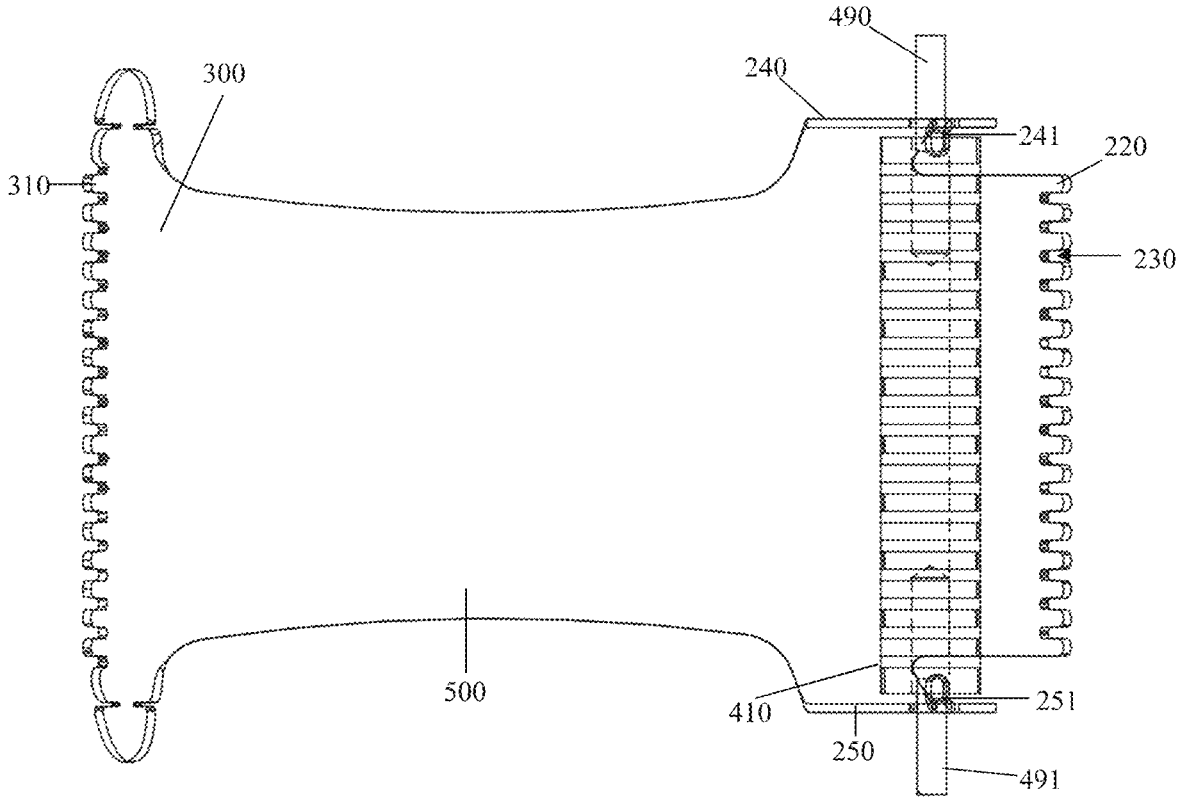

FIGS. 21-22 are respectively a perspective and a top view of the heddle 400 rotatably coupled with the first and second heddle rests 240, 250 of the base 100. The heddle 400 includes a first bar 490 that passes through the opening on the first heddle rest 240, enters the first hole 480 on the central part 410, and securely couple with the heddle 400. Similarly, the heddle 400 includes a second bar 491 that passes through the opening on the second heddle rest 250, enters the second hole 481 on the central part 410, and securely couple with the heddle 400. A user can use either one of the two bars 490 to rotate the heddle 400 in either a clockwise or a counterclockwise direction, in order for the shedding sections 430 of the central part 400 to push different warp threads upwards. Please note that almost every one of the first and second slots 441, 442 faces a first gap 230.

In the present embodiment, the central part 410 is substantially rectangular. As the heddle 400 is rotated, the first and second stops 241, 242 on the first and second heddle rests 240, 250 will eventually block the central part 410 and prevent it from being rotated any further. At that moment, about half of the shedding sections 430 on the central part 410 preferably face vertically upward to contact the corresponding warp threads and move them either upward or downward.

Figure 23:
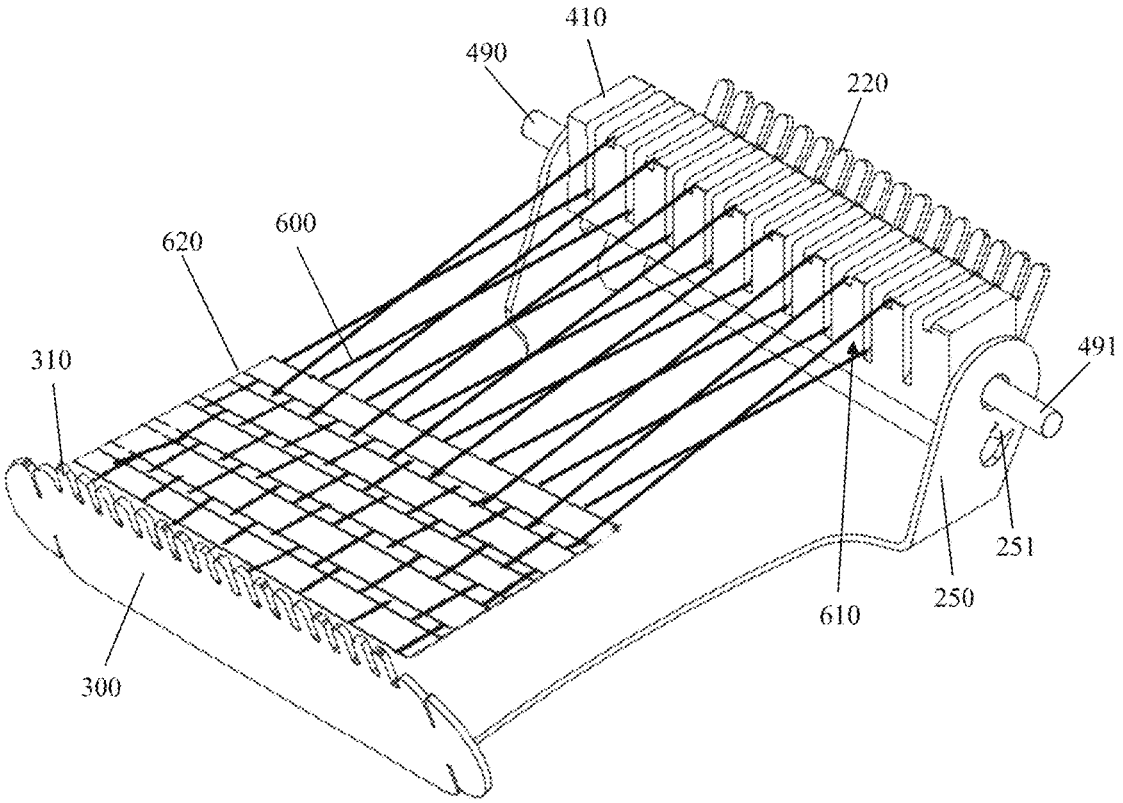
FIG. 23 is a perspective view of the weaving loom having a warp formed between two opposite ends of the base according to the second embodiment of the present disclosure.
Figure 24:
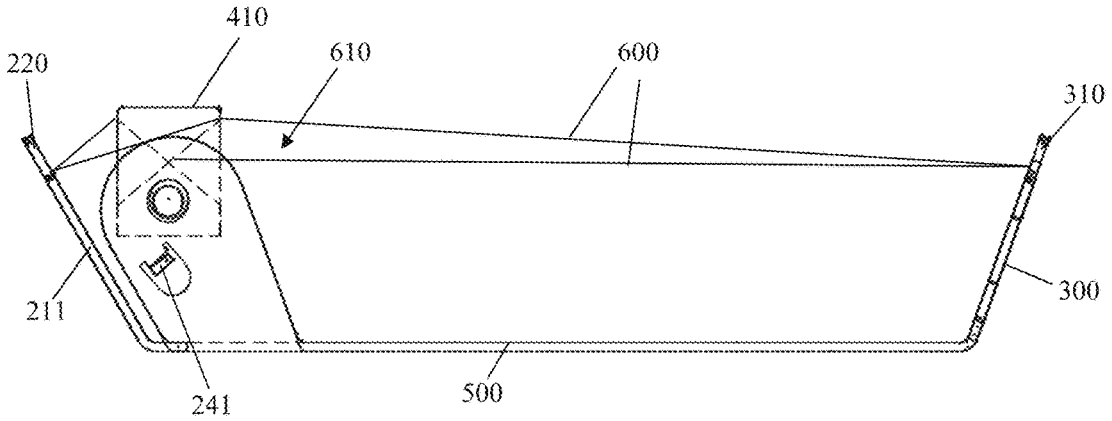
FIG. 24 is a side view of the weaving loom having a warp formed between two opposite ends of the base according to the second embodiment of the present disclosure.

FIG. 23 is a perspective views and FIG. 24 is a side view of the weaving loom having a plurality of warp threads formed between the first and second pins 220, 310. The weaving loom of the present embodiment allows user to create warp threads after coupling the base with the heddle. To create the warp threads 600 illustrated in FIG. 23, the user can start by wrapping the warp thread 600 around one first pin 220 at one end of the base and then wrap the same warp thread around the second pin 310 on the other end of the base. The very first warp thread 600 has just been created on the weaving loom. The user can repeat the warp creating process until the warp threads are wrapped around most of the first pin 220 and second pin 310. The user can then finish the warping process by tying one end of the warp thread 600 with the fixing gaps on the other end of the second base portion 300. It is also advisable to tenson the warp threads 600 equally when wrapping them around the first and second pins 220, 310. The user should also make sure the warp threads 600 are properly wrapped around the pins 220, 310 and it's not going to slide down later, as it might mess the tension of the overall warp.

To create a fabric, a shed 610 or a space separation must be created between two groups of warp threads. Basically, the shed 610 is the temporary separation between upper and lower warp threads 600 through which the wefts 620 are woven and the fabric is made. The shed 610 is created to make it easy to interlace the weft into the warp threads 600 and thus create woven fabric. The shed 610 allows for a shuttle carrying the weft threads or simply a single weft thread to move through the shed 610 relative to the warp threads 600. Which warp threads 600 are raised or which are lowered are changed after each pass of the weft thread.

To create a shed 610, the user rotates the heddle by turning either one of the first and second bars 490, 491 in either a clockwise or anti-clockwise direction. When the first or second bar 490, 491 is turned in a clockwise/counterclockwise direction, the central part 410 is also rotated in the same direction. The shedding sections 440 across one longitudinal section of the central part 410, in the process of being rotated, raises a plurality of warp threads 600 above the rest. As the heddle is turned, eventually the first and second stops 241, 251 contact the heddle central part 410 and prevents the user from rotating the heddle any further. This is also the moment the user can start creating weft 620 by passing the weft thread through the newly created shed 610.

To create another weft 620, the user turns the heddle in the opposite direction. Now the shedding sections 440 across another longitudinal section of the central part 410 the part of the central part 410 associated with the second grooves moves and, in the process, raises a group of warp threads different from the group mentioned in the previous paragraph. A different shed 610 is created and gradually increased in size as the heddle is turned. At some point the central part 410 will the first and second stops 241, 251 and the heddle can no longer be turned. This is the moment the user can create another weft 620 by passing the weft thread through the second shed 610. The user can still decide to make the same weft again by passing the weft thread through the shed 610.

The user can then start making a different weft by rotating the heddle in another direction and passing the weft thread through another shed. The wefting process continues until the desired fabric pattern or fabric is complete to the user's satisfaction.

Figure 25:
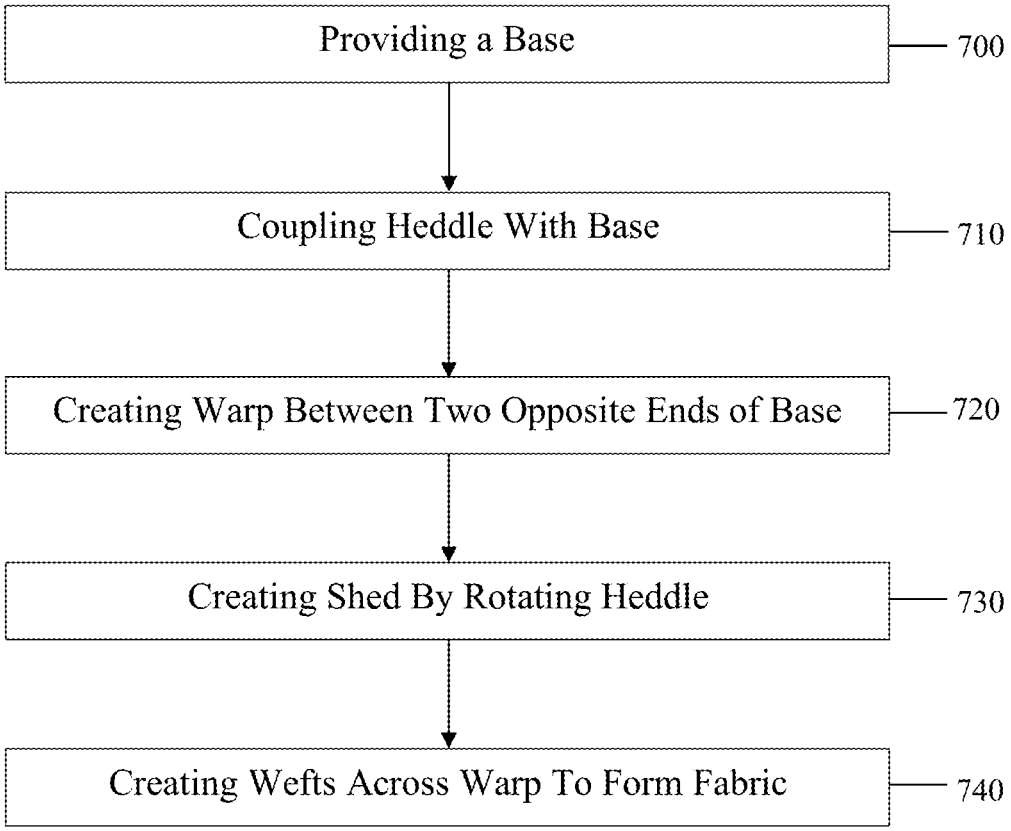
FIG. 25 is a flow of a method of making a piece of fabric according to a third embodiment of the present disclosure.

FIG. 25 is a flow of a method of making a piece of fabric according to one embodiment of the present disclosure. The method includes step 700 of providing a base having a first and second portions on two opposite sides of the base. The base can be the bases illustrated in FIGS. 1-16, the base illustrated in FIGS. 17-24, or other bases having similar or comparable features. Many alterations and modifications of the base may be made by those having ordinary skill in the art without departing from the spirit and scope of the embodiments and claims.

The method further includes step 710 of detachably coupling a heddle with the base. The manner the heddle and base are coupled depends on the structure of the heddle and the corresponding heddle rests on the base. For instance, coupling the heddle 400 illustrated in FIG. 4 with the base in FIG. 1 involves letting the first and second heddle rests of the base pass through the corresponding first and second grooves 450, 460 of the heddle 400 and couple with the axle of the heddle 400. For the heddle 400 in FIGS. 19-20 and base 100 in FIG. 17, coupling the heddle 400 with the base 100 involves passing two bars 490, 491 through an opening on the two heddle rests 240, 250 and enter the holes on two opposite sides of the central part 410, to rotatably couple the heddle rest 240, 250 with the central part 410.

The method further includes step 720 of creating a warp. To create a warp, the user can start by wrapping the warp thread around one first pin at one end of the base and then wrap the same warp thread around the second pin on the other end of the base. The very first warp has just been created on the weaving loom. The user can repeat the warp creating process until the warp thread wraps around a pair of first pin and second pin at least once to form the warp. It is also advisable to tenson the warp thread equally when wrapping around the first and second pins. The user should also make sure the warp thread is properly wrapped around the first and second pins and it's not going to slide down later, as it might mess the tension of the overall warps.

The method further includes step 730 of creating sheds by rotating the heddle. The shed is the temporary separation between upper and lower warp threads through which the weft is woven. The sheds are generally equal in size but can still differ based on different portion of the warp raised by the heddle. The portion of the warp elevated by the heddle corresponds directly with the position of the heddle's shedding sections facing upward. The heddle of the present disclosure includes different sets of grooves across different longitudinal sections of the heddle. For instance, the heddle illustrated in FIGS. 19-20 includes two longitudinal sections having different sets of shedding sections for moving certain portions of the warp upward and grooves for accommodate the other portion of the warp. Thus, the heddle in FIGS. 19-20 is configured to create only two types of shed that correspond to two sets of upper and lower warp threads. On the other hand, the heddle illustrated in FIGS. 4-8 includes four longitudinal sections having different sets of shedding sections for moving different portion of the warp upward and grooves for accommodating the other portion of the warp. Thus, the heddle in FIGS. 4-8 is configured to create four types of shed that correspond to four sets of upper and lower warp threads. In other embodiments, the heddle can be configured to have more than four longitudinal sections having different sets of shedding sections and grooves to create more than four types of shed.

The method further includes step 740 of creating wefts to form a fabric. The user can use a shuttle to move weft threads or simply move a single weft thread through the shed. The weft created depends on the shed separation between upper and lower warps through which the weft is woven. Thus, the number of different wefts that the user can weave depends on the types of sheds that can be created and the number of longitudinal sections with different sets of shedding sections and grooves formed on the heddle.

As discussed above, a fabric is a collection of different wefts woven in a particular order, wherein different wefts correspond to different sheds between upper and lower warp threads. The user can thus make different fabrics by varying the order that different sheds are created and thus the order different wefts are woven.

For the embodiment illustrated in FIGS. 17-24, the heddle only has two longitudinal sections of shedding sections and grooves which gives the user only two choices of shed and weft to create a fabric. The user can start with a first longitudinal section to make a first shed and then move the weft thread therethrough to create a first weft. Afterwards, the user has only two choices. The user can either make another first weft or rotate the heddle to create a second shed and then move the weft thread therethrough to make a second weft. The user then has to decide whether to make another second weft or rotate the heddle to make another first weft.

For the embodiment illustrate in FIGS. 1-12, the heddle has 4 different two longitudinal sections of shedding sections and grooves for the user to choose from. Thus, the heddle allows the user to create a first shed, a second shed, a third shed, and a fourth shed that correspond to four different sets of upper and lower warp threads. Accordingly, the heddle allows the user to make a first weft, a second shed, a third weft, and a fourth weft that correspond respectively with the above-mentioned sheds. The choices give the user an exponential increase in the number of orders he/she can choose to create sheds and wefts to form a fabric. The user can start with a first longitudinal section to make a first shed and then move the weft thread therethrough to create a first weft. Now the user has 4 choices. The user can make another first weft or rotate the heddle to create a second, third, or fourth shed and then move the weft thread therethrough to make a second, third, or fourth weft. The user can then make the same weft again or make a different one out of the three other weft choices. Further, the heddle in FIGS. 1-12 is configured to be rotated in full 360 degree. Thus, the user can jump around different longitudinal sections of the heddle to make different sheds and different wefts. For instance, the user can make a first weft, a second weft next, and then a third weft. Afterward, the user can freely rotate the heddle to make a second shed followed by another second weft, a third shed followed by another third weft, or a new fourth shed followed by a new fourth weft.

Reference throughout this specification to "one embodiment," "an embodiment," "one example," or "an example" means that a particular feature, structure, or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures, databases, or characteristics may be combined in any suitable combinations and/or sub-combinations in one or more embodiments or examples. In addition, it should be appreciated that the figures provided herewith are for explanation purposes to people ordinarily skilled in the art and that the drawings are not necessarily drawn to scale.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims. It is also understood that other embodiments of this invention may be practiced in the absence of an element/step not specifically disclosed herein.

The invention claimed is:

1. A weaving loom comprising:

a base including:

a first base portion having:

a heddle base;

a plurality of first pins extending from the heddle base, wherein a first gap exists between the two adjacent first pins;

a second base portion having a plurality of second pins, wherein a second gap exists between the two adjacent second pins; and a heddle detachably coupled with the heddle base, the heddle including a central part having an axis and including:

a plurality of pin section formed on the central part and around the axis, wherein at least one half of the pin sections correspond to the first pins positionally;

a plurality of shedding sections formed on the central part and around the axis, wherein each of the most shedding sections is located between the two pin sections, each of the shedding sections has a groove, the shedding sections are arranged along the axis for the central part to have a plurality of longitudinal rows having different topographies across different longitudinal portions of the central part, the heddle is configured to move between a plurality of positions with one of the longitudinal rows facing vertically upward.

2. The weaving loom of claim 1, wherein the first base portion further has:

a first heddle rest extending from a first side of the heddle base; and a second heddle rest extending from a second side of the heddle base opposite to the first side, wherein the heddle is detachably coupled with the first heddle rest and the second heddle rest.

3. The weaving loom of claim 2, wherein the heddle includes:

a first groove for the first heddle rest to move within the first groove and couple with the heddle; and a second groove for the second heddle rest to move within the second groove and couple with the heddle.

4. The weaving loom of claim 1, further comprising a base connector having two connector ends coupled respectively with the first base portion and the second base portion.

5. The weaving loom of claim 1, wherein the first pins extend obliquely from the heddle base, the second pins are oriented obliquely relative to the heddle base.

6. The weaving loom of claim 1, wherein each of the pin sections is a full discs and each of the shedding sections is a partial disc, wherein each of the partial discs is located between two full discs, each of the partial discs positionally corresponds to one of the first gaps and one of the second gaps.

7. The weaving loom of claim 6, wherein the partial disc collectively form the longitudinal rows having different sets of grooves distributed along the longitudinal sections of the central part.

8. The weaving loom of claim 1, wherein the heddle includes a knob configured for a user to manually rotate the heddle in order for the different longitudinal rows to face vertically upward.

9. The weaving loom of claim 1, further comprising a warp located above the heddle and formed between the first pins and the second pins, wherein the warp is wrapped around the first and second pins and extending from the first pins toward the second pins or from the second pins to the first pins, one of the longitudinal rows on the heddle moves a portion of the warp up to form a shed separation between moved and unmoved portions of the warp.

10. The weaving loom of claim 9, wherein the central part includes:

a first longitudinal row having a first formation of the grooves;

a second longitudinal row having a second formation of the grooves; and a third longitudinal row having a third formation of the grooves;

the heddle is configured to be moved to:

a first position for the first longitudinal row to move a portion of the warp to from a first shed;

a second position for the second longitudinal row to move another portion of the warp to form a second shed; and a third position for the third longitudinal row to move yet another portion of the warp to form a third shed.

11. The weaving loom of claim 1, wherein the heddle includes a first heddle end located at one end of the central part, the first heddle end includes a plurality of row designations corresponding respectively to one of the longitudinal rows.

12. The weaving loom of claim 1, wherein the central part is cylindrical, cubical, triangular, cuboid, or hexagonal.

13. The weaving loom of claim 1, wherein the first base portion further includes:

a first heddle rest extending from a second side of the heddle base and having a first stop; and a second heddle rest extending from a third side of the heddle base and having a second stop; wherein the central part has a first longitudinal row and a second longitudinal row having different arrangements of the grooves across different longitudinal portions of the central part;

the heddle is configured to move between:

a first position where a first side of the central part rests on the first and second stops, the first row faces vertically upward; and a second position where a second side of the central part rests on the first and second stops, the second row faces vertically upward.

14. The weaving loom of claim 13, wherein the shedding sections have:

a plurality of first grooves with a first depth; and a plurality of second grooves with a second depth, wherein the first depth is greater than the second depth; wherein the first groove is adjacent to only the second grooves, the second groove is adjacent to only the first grooves.

15. The weaving loom of claim 13, wherein the shedding sections have:

a plurality of first grooves; and a plurality of second grooves; wherein the first groove is adjacent to at least another of the first grooves, the second groove is adjacent to at least another of the second grooves.

16. The weaving loom of claim 13, wherein the central part further includes:

a first hole extending across a length of the central part;

a second hole extending across the length of the central part;

the heddle further includes:

a first bar passing through the first hole to couple with the central part and coupling with the first heddle rest; and a second bar pass through the second hole to couple with the central part and coupling with the second heddle rest.

17. A method for producing a fabric, said method comprising the following steps:

providing a base including:

a first base portion having:

a heddle base;

a plurality of first pins extending from the heddle base, wherein a first gap exists between the two adjacent first pins; and a second base portion having a plurality of second pins, wherein a second gap exists between the two adjacent first pins;

detachably coupling a heddle with the base, wherein the heddle includes an axis and a central part having a plurality of shedding sections, the shedding sections are formed on the central parts and around the axis, the central part has a first row, a second row, and a third row having different sets of shedding sections distributed along different longitudinal sections of the central part;

creating a warp by passing at least one warp thread around first pins and the second pins;

creating a first shed between the warps by shedding a portion of the warp vertically upward with the shedding sections corresponding to the first row;

creating a first weft by passing a weft thread through the first shed;

creating a second shed between the warps by rotating the heddle and shedding a portion of the warp vertically upward with the shedding sections corresponding to the second row; and creating a second weft by passing the weft thread through the second shed;

creating a third shed between the warps by shedding a portion of the warp vertically upward with the shedding sections corresponding to the third row; and creating a third weft by passing a weft thread through the third shed.

18. The method for producing a fabric of claim 17, further comprising:

creating the second shed between the warps by rotating the heddle and shedding a portion of the warp with the shedding sections corresponding to the second longitudinal row;

creating the second weft by passing the weft thread through the second shed;

creating the first shed between the warps by shedding a portion of the warp with the shedding sections corresponding to the first longitudinal row; and creating the first weft by passing a weft thread through the first shed.

19. The method for producing a fabric of claim 17, further comprising:

creating the first shed between the warps by rotating the heddle and shedding a portion of the warp with the shedding sections corresponding to the first longitudinal row;

creating the first weft by passing the weft thread through the first shed;

creating the second shed between the warps by shedding a portion of the warp with the shedding sections corresponding to the second longitudinal row; and creating the second weft by passing a weft thread through the second shed.

20. The method for producing a fabric of claim 17, further comprising:

creating a fourth shed between the warps by rotating the heddle and shedding a portion of the warp with the shedding sections corresponding to a fourth longitudinal row; and creating the fourth weft by passing the weft thread through the fourth shed.

* * * * *